US005984127A

United States Patent [19]

Fenton

[11] Patent Number: 5,984,127

[45] Date of Patent: Nov. 16, 1999

[54] RESEALABLE CAN COVER

[76] Inventor: Robert C. Fenton, 222 Audrey Alene, San Antonio, Tex. 78216

[21] Appl. No.: 09/037,808

[22] Filed: Mar. 10, 1998

[51] Int. Cl.[6] ..... B65D 51/18

[52] U.S. Cl. ..... 220/254; 220/713; 220/718; 220/375

[58] Field of Search ..... 220/254, 269, 220/713, 718, 375

[56] References Cited

U.S. PATENT DOCUMENTS 5,029,719 7/1991 Solomon ..... 215/229
5,054,640 10/1991 Tucker ..... 220/254 X
5,088,614 2/1992 Dumestre ..... 220/713
5,720,408 2/1998 Schmid et al. ..... 220/287

*Primary Examiner*—Stephen K. Cronin

[57] ABSTRACT

A can cover is provided including a cover plate having a periphery with an annular peripheral lip coupled thereto and depending downwardly therefrom. The cover plate is adapted to be removably secured to a top of a can. A lid assembly is provided including a flange integrally coupled to a top face of the cover plate about a cut out formed therein. A cap is included for defining an open bottom for releasably securing to the flange. Connected between the cap and the cover plate is a string.

11 Claims, 1 Drawing Sheet

RESEALABLE CAN COVER

BACKGROUND OF THE INVENTION

1. Field of the Invention

The present invention relates to can covers and more particularly pertains to a new resealable can cover for selectively sealing an opened can.

2. Description of the Prior Art

The use of can covers is known in the prior art. More specifically, can covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art can covers include U.S. Pat. No. 5,240,132; U.S. Pat. No. 2,764,200; U.S. Pat. No. 5,108,003; U.S. Pat. No. 4,938,379; U.S. Pat. No. 4,938,379; U.S. Pat. No. 3,335,893; and Foreign Patents WO 94/07755 A1 and EP 0 454 889 A1.

In these respects, the resealable can cover according to the present invention substantially departs from the conventional concepts and designs of the prior art, and in so doing provides an apparatus primarily developed for the purpose of selectively sealing an opened can.

SUMMARY OF THE INVENTION

In view of the foregoing disadvantages inherent in the known types of can covers now present in the prior art, the present invention provides a new resealable can cover construction wherein the same can be utilized for selectively sealing an opened can.

The general purpose of the present invention, which will be described subsequently in greater detail, is to provide a new resealable can cover apparatus and method which has many of the advantages of the can covers mentioned heretofore and many novel features that result in a new resealable can cover which is not anticipated, rendered obvious, suggested, or even implied by any of the prior art can covers, either alone or in any combination thereof.

To attain this, the present invention generally comprises a cover plate constructed from a resilient elastomeric material. The cover has a planar circular configuration and a periphery with an annular peripheral lip integrally coupled thereto and depending downwardly therefrom. The peripheral lip has a lower edge with an inner surface having an inwardly extending lip coupled thereto and extending radially inwardly therefrom. By this structure, the cover plate is adapted to be removably secured to a top of a can. As such, the inwardly extending lip abuts a lower edge of a rim of the can. Note FIG. 3. FIGS. 1 & 2 show a drinking funnel including a portion of a cylinder. The drinking funnel is coupled to a bottom face of the cover plate about a circular cut out formed therein. In use, the funnel is situated about an axis which resides in parallel with that of the cap. Also included is a lid assembly having a cylindrical flange integrally coupled to a top face of the cover plate about the cut out and extended upwardly therefrom. A cap is provided including a circular top face and an annular peripheral lip integrally coupled thereto and depending downwardly therefrom. An open bottom is thus defined for releasably securing to the flange. The lid assembly further includes a string connected between the lip of the cap and the top face of the cover plate adjacent to the cut out. Finally, a thumb tab is provided having a triangular configuration. An apex of the tab is integrally coupled the lip of the cover plate diametrically opposite the cut out.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new resealable can cover apparatus and method which has many of the advantages of the can covers mentioned heretofore and many novel features that result in a new resealable can cover which is not anticipated, rendered obvious, suggested, or even implied by any of the prior art can covers, either alone or in any combination thereof.

It is another object of the present invention to provide a new resealable can cover which may be easily and efficiently manufactured and marketed.

It is a further object of the present invention to provide a new resealable can cover which is of a durable and reliable construction.

An even further object of the present invention is to provide a new resealable can cover which is susceptible of a low cost of manufacture with regard to both materials and labor, and which accordingly is then susceptible of low prices of sale to the consuming public, thereby making such resealable can cover economically available to the buying public.

Still yet another object of the present invention is to provide a new resealable can cover which provides in the apparatuses and methods of the prior art some of the advantages thereof, while simultaneously overcoming some of the disadvantages normally associated therewith.

Still another object of the present invention is to provide a new resealable can cover for selectively sealing an opened can.

Even still another object of the present invention is to provide a new resealable can cover that includes a cover plate having a periphery with an annular peripheral lip coupled thereto and depending downwardly therefrom. The cover plate is adapted to be removably secured to a top of a can. A lid assembly is provided including a flange integrally coupled to a top face of the cover plate about a cut out formed therein. A cap is included for defining an open bottom for releasably securing to the flange. Connected between the cap and the cover plate is a string.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
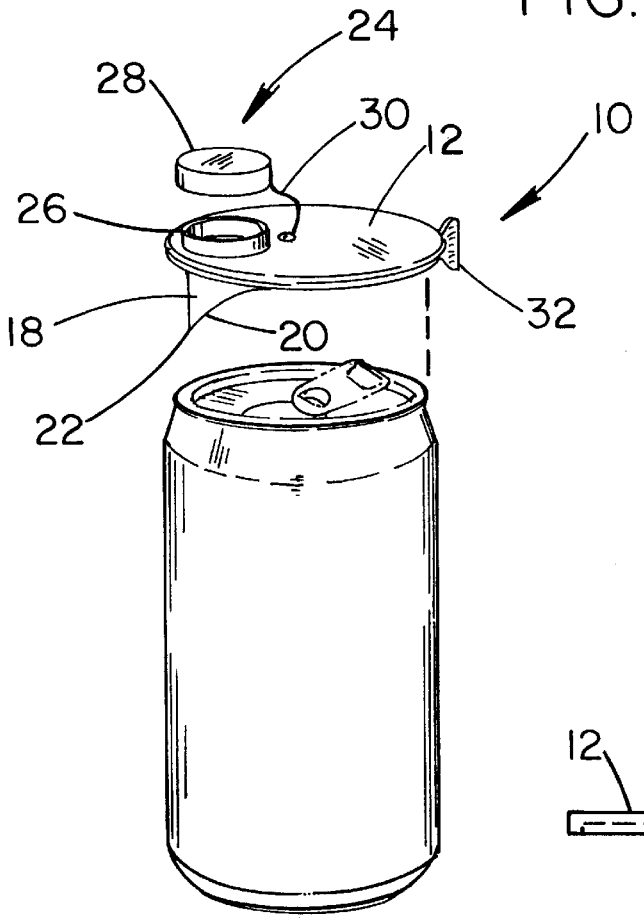
FIG. 1 is a perspective view of a new resealable can cover according to the present invention.
Figure 2:
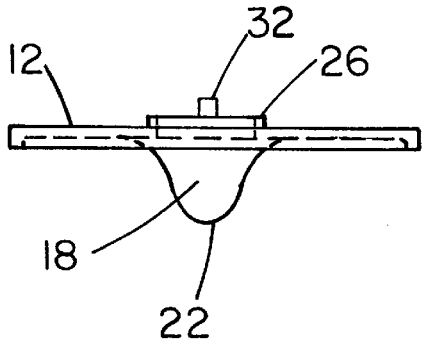
FIG. 2 is a side view of the present invention.
Figure 3:
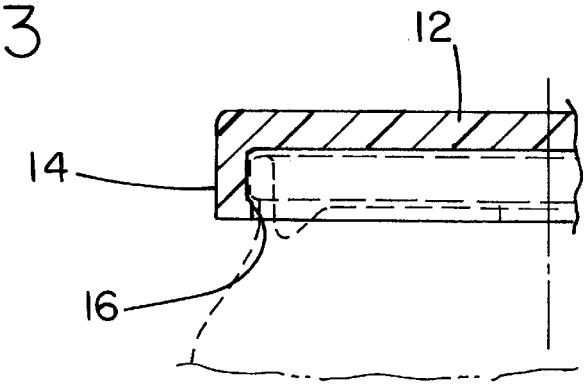
FIG. 3 is a close-up cross-sectional view of the present invention showing the securement of the cover plate to the can.

With reference now to the drawings, and in particular to FIGS. 1 through 3 thereof, a new resealable can cover embodying the principles and concepts of the present invention and generally designated by the reference numeral 10 will be described.

The present invention, designated as numeral 10, includes a cover plate 12 constructed from a resilient elastomeric material. The cover has a planar circular configuration and a periphery with an annular peripheral lip 14 integrally coupled thereto and depending downwardly therefrom. The peripheral lip has a lower edge with an inner surface having an annular inwardly extending lip 16 coupled thereto and extending radially inwardly therefrom.

By this structure, the cover plate is adapted to be removably secured to a top of a can. As such, the inwardly extending lip abuts a lower edge of a rim of the can. Note FIG. 3.

FIGS. 1 & 2 show a drinking funnel 18 defined by a portion of a cylinder. The drinking funnel is integrally coupled to a bottom face of the cover plate about a circular cut out formed therein. In use, the funnel is situated about an axis which resides in parallel with that of the cap. As shown in FIGS. 1 & 2, the funnel is generally formed by a portion of a cylinder with beveled edges 20. Such edges terminate at a blunt bottom 22 which depends lower than the peripheral lip of the cover plate. It should further be noted that a lowest point of the funnel is situated adjacent the periphery of the can in use. In use, the funnel functions to ensures the securement of the cover plate on the can such that the cut out is in alignment with the opening of the can.

Also included is a lid assembly 24 having a cylindrical flange 26 integrally coupled to a top face of the cover plate about the cut out and extended upwardly therefrom. A cap 28 is provided including a circular top face and an annular peripheral lip integrally coupled thereto and depending downwardly therefrom. An open bottom is thus defined for releasably securing to the flange. The lid assembly further includes a string 30 connected between the lip of the cap and the top face of the cover plate adjacent to the cut out.

Finally, a thumb tab 32 is provided having a triangular configuration. An apex of the tab is integrally coupled the lip of the cover plate diametrically opposite the cut out. The thumb tab resides within a plane perpendicular with respect to that in which the cover plate resides. It should be noted that the plane further passes through a center point of the cover plate. In other words, the thumb tab extends radially from the cover plate.

As an option, a sealing film may be formed about the cut out. Such film is adapted to be peeled off prior to use. It should be understood that this option would be included if the cover plate is incorporated with the can at time of manufacture.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A can cover comprising:

a cover plate constructed from a resilient elastomeric material and having a planar circular configuration and a periphery with an annular peripheral lip integrally coupled thereto and depending downwardly therefrom, the peripheral lip having a lower edge with an inner surface having an inwardly extending lip coupled thereto and extending radially inwardly therefrom, wherein the cover plate is adapted to be removably secured to a top of a can such that the inwardly extending lip abuts a lower edge of a rim of the can wherein a circular cutout is formed in the cover plate and being adapted for alignment with an opening in the top of the can;

a drinking funnel including a portion of a cylinder integrally coupled to a bottom face of the cover plate having a lumen aligned with the circular cutout formed in the cover plate, the funnel depending downwardly from the bottom face such that the drinking funnel is adapted for extending into the can through the opening in the top of the can for protecting a user from any sharp edges around the opening in the can, the drinking funnel terminating at a lower edge, the lower edge lying in a plane oriented at an angle to the plane of the cover plate such that the lowermost portion of the funnel tapers to form a point for guiding the funnel into the opening during mounting of the cover plate on a can, the funnel situated about an axis which resides in parallel with that of the cap;

a lid assembly including a cylindrical flange integrally coupled to a top face of the cover plate about the cut out and extending upwardly therefrom, a cap including a circular top face and an annular peripheral lip integrally coupled thereto and depending downwardly therefrom for defining an open bottom for releasably securing to the flange, and a string connected between the lip of the cap and the top face of the cover plate adjacent to the cut out; and a thumb tab having a triangular configuration with an apex thereof integrally coupled to an outer surface of the lip of the cover plate diametrically opposite the cut out, the thumb tab residing within a plane perpendicular with respect to that in which the cover plate resides and further passing through a center point of the cover plate.

2. A can cover comprising:

a cover plate having a periphery with an annular peripheral lip coupled thereto and depending downwardly therefrom, wherein the cover plate is adapted to be removably secured to a top of a can; and a lid assembly including a flange integrally coupled to a top face of the cover plate about a cut out formed therein, a cap for releasably securing to the flange, and a string connected between the cap and the cover plate; and a drinking funnel including a portion of a cylinder integrally coupled to a bottom face of the cover plate having a lumen aligned with the circular cutout formed in the cover plate, the funnel depending downwardly from the bottom face such that the drinking funnel is adapted for extending into the can through the opening in the top of the can for protecting a user from any sharp edges around the opening in the can.

3. The can cover as set forth in claim 2, further comprising:

the drinking funnel terminating at a lower edge, the lower edge lying in a plane oriented at an angle to the plane of the cover plate such that the lowermost portion of the funnel tapers to form a point for guiding the funnel into the opening during mounting of the cover plate on a can.

4. A can cover as set forth in claim 2 wherein the drinking funnel includes a portion of a cylinder integrally coupled to said bottom face of the cover plate about the cut out formed therein.

5. A can cover as set forth in claim 2 wherein the cover plate is constructed from a resilient elastomeric material.

6. A can cover as set forth in claim 2 wherein the peripheral lip of the cover plate has a lower edge with an inner surface having an inwardly extending lip coupled thereto and extending radially inwardly therefrom.

7. A can cover as set forth in claim 2 and further including a tab extending from the cover plate.

8. A can cover as set forth in claim 7 wherein the tab has a triangular configuration with an apex thereof integrally coupled to an outer surface of the lip of the cover plate.

9. A can cover as set forth in claim 7 wherein the tab resides within a plane perpendicular with respect to that in which the cover plate resides.

10. A can cover comprising:

a cover plate having a periphery with an annular peripheral lip coupled thereto and depending downwardly therefrom, wherein the cover plate is adapted to be removably secured to a top of a can; and a cut out formed in the cover plate; and alignment means coupled to the cover plate and depending therefrom adapted for insertion within an opening of the can when said cover plate is coupled to the can.

11. A can cover as set forth in claim 10 wherein the alignment means includes a funnel.

* * * * *